US010039965B1

(12) United States Patent
Seluga et al.

(10) Patent No.: US 10,039,965 B1
(45) Date of Patent: Aug. 7, 2018

(54) IRON-TYPE GOLF CLUB HEAD WITH DAMPING FEATURES

(71) Applicant: Callaway Golf Company, Carlsbad, CA (US)

(72) Inventors: James A. Seluga, Carlsbad, CA (US); Matthew Myers, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 15/821,557

(22) Filed: Nov. 22, 2017

(51) Int. Cl.

| | |
|---|---|
| ***A63B 53/08*** | (2015.01) |
| ***A63B 53/04*** | (2015.01) |
| *A63B 60/54* | (2015.01) |
| *A63B 60/00* | (2015.01) |

(52) U.S. Cl.
CPC ..... *A63B 53/0475* (2013.01); *A63B 53/047* (2013.01); *A63B 53/08* (2013.01); *A63B 60/54* (2015.10); *A63B 2053/042* (2013.01); *A63B 2053/0416* (2013.01); *A63B 2053/0433* (2013.01); *A63B 2060/002* (2015.10)

(58) Field of Classification Search
CPC . A63B 53/08; A63B 60/54; A63B 2053/0416; A63B 53/042; A63B 2060/002; A63B 53/0475; A63B 53/047
USPC ..... 473/342, 332, 324
See application file for complete search history.

(56) References Cited

U.S. PATENT DOCUMENTS

| | | | | |
|---|---|---|---|---|
| 5,967,903 | A * | 10/1999 | Cheng | A63B 53/04 473/342 |
| 7,194,393 | B2 * | 3/2007 | Wei | G06K 9/00067 382/190 |
| 7,476,162 | B2 * | 1/2009 | Stites | A63B 53/04 473/332 |
| 7,922,604 | B2 * | 4/2011 | Roach | A63B 53/047 473/350 |
| 8,777,776 | B2 * | 7/2014 | Wahl | A63B 53/0466 473/342 |
| 8,911,301 | B1 * | 12/2014 | Allen | A63B 53/047 473/329 |
| 9,827,469 | B1 * | 11/2017 | Seluga | A63B 53/0466 |
| 9,937,388 | B2 * | 4/2018 | Cardani | A63B 53/04 |

* cited by examiner

*Primary Examiner* — Benjamin Layno
(74) *Attorney, Agent, or Firm* — Rebecca Hanovice; Michael Catania; Sonia Lari

(57) ABSTRACT

An iron-type golf club head comprising a body with a striking face and a hollow cavity portion, a medallion, and a damping insert that is spaced from, and does not contact any portion of, the striking face is disclosed herein. The damping insert is trapped between the medallion and a support structure that extends from the body of the club head approximately parallel with the striking face, and is at least partially suspended over or in the cavity portion. The structure may be an elongated stiffening member that connects upper and lower portions of the body to one another, or a rectangular lip section. The damping insert is affixed to only one of the medallion and the structure with an adhesive material, and damps vibration in the striking face after the striking face makes contact with a golf ball, while the striking face is rebounding from impact.

20 Claims, 9 Drawing Sheets

IRON-TYPE GOLF CLUB HEAD WITH DAMPING FEATURES

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

Field of the Invention

The present invention relates to a golf club head, and particularly an iron-type golf club head, with an insert that damps vibrations in the striking face of the golf club head when the striking face is rebounding from impact with a golf ball.

Description of the Related Art

The prior art discloses various golf club heads having vibration damping inserts sandwiched or wedged between the golf club head striking face and another body portion of the club head. For example, U.S. Pat. No. 5,492,327 to Biafore discloses an iron with a damping material in a recess proximate a striking face, U.S. Pat. No. 6,743,117 to Gilbert discloses a dampening insert behind a strike face insert in an iron, and U.S. Pat. No. 9,168,437 to Roach et al. discloses an elastomeric insert attached to the back of the striking face of an iron. In these prior art clubs, the damping effect of the insert occurs as soon as the striking face impacts a golf ball, such that the damping insert is compressed between the striking face and some other portion of the golf club head. This process damps vibrations in the striking face, but also reduces the coefficient of restitution (COR) of the face, thereby reducing face performance in exchange for better sound. Therefore, there is a need for a vibration damping structure that improves sound without negatively affecting performance of the golf club head.

BRIEF SUMMARY OF THE INVENTION

The golf club head of the present invention comprises a damping insert, also referred to herein as a bumper, that damps vibrations in the striking face after an impact between the club head and a golf ball. The purpose of the structure is to avoid impeding the performance of variable thickness technology in the striking face on ball velocity, and thereby avoid reduction of COR, while at the same time reducing unwanted vibrations in the striking face. The damping effect of the inventive structure is produced while the striking face is rebounding after the golf ball has left the striking face.

One aspect of the present invention is an iron-type golf club head comprising a body comprising a top line section, a bottom section, a face section comprising a striking face surface and a rear face surface, a heel side, a toe side, and a hollow cavity at least partially defined by the top line section, bottom section, and face section, at least one support structure (for example, a stiffening rod or a lip) extending from the bottom section into the hollow cavity approximately parallel with the rear face surface, a medallion comprising a front medallion surface and a rear medallion surface, and a damping insert such as a bumper, wherein no portion of the at least one support structure makes direct contact with the face section, wherein the front medallion surface is affixed to the rear face surface so that a portion of the medallion extends over at least a portion of the at least one support structure, wherein the bumper is disposed between the front medallion surface and the at least one support structure, wherein the bumper is affixed to only one of the medallion and the at least one support structure with an adhesive material, wherein a portion of at least one of the medallion and the at least one bumper moves away from the face section when the face section impacts a golf ball, and wherein the bumper damps vibration in the face section after impact with the golf ball.

In some embodiments, the at least one support structure may be an elongated rod extending from the bottom section to the top line section so that a middle portion of the at least one support structure is suspended within the hollow cavity. In other embodiments, the medallion may comprise a through-opening extending from the rear medallion surface to the front medallion surface, the bumper may comprise a rear protrusion, and the rear protrusion may extend into the through-opening when the medallion is affixed to the face section. In still other embodiments, the face section may be a face cup comprising an upper flange and a lower flange, the upper flange may be welded to the top line section, and the lower flange may be welded to the bottom section. In each embodiment, no portion of the front medallion surface may make direct contact with the at least one support structure, and no portion of the bumper may make direct contact with the face section.

Another aspect of the present invention is a golf club head comprising a body comprising a top line section, a bottom section, a hosel disposed at a heel side, and a toe side opposite the heel side, a face component comprising a striking face surface, a rear face surface opposite the striking face surface, an upper flange, and a lower flange, an elongated stiffening rod, a medallion comprising an elongated vertical channel, and a bumper, wherein the upper flange is permanently affixed to the top line section and the lower flange is permanently affixed to the bottom section to define an internal cavity, wherein the elongated stiffening rod extends from the bottom section to the top line section through the internal cavity, wherein the elongated stiffening rod extends approximately parallel with the rear face surface without making contact with any portion of the face component, wherein the medallion is affixed to the rear face surface, wherein a middle portion of the elongated stiffening rod is disposed within the elongated vertical channel, wherein the bumper is disposed between the elongated stiffening rod and the medallion within the elongated vertical channel, wherein no portion of the bumper makes contact with any portion of the face component, and wherein the bumper damps vibration in the striking face.

In some embodiments, the bumper may be affixed to only one of the elongated stiffening rod and the medallion with an adhesive material. In other embodiments, the medallion may comprise an opening, the bumper may comprise a protrusion, and the protrusion may extend into the opening. In any of the embodiments, the medallion may be composed of plastic and the bumper may be composed of rubber. In some embodiments, the elongated stiffening rod may be integrally cast with the body, the body may be composed of a first metal alloy material, and the face component may be composed of a second metal alloy material that is different from the first metal alloy material. In other embodiments, the elongated stiffening rod may be disposed less than 0.500 inch from the rear face surface. In another embodiment, the elongated stiffening rod may have a cylindrical shape with a first diameter, and the elongated vertical channel may have an approximately tubular cross-sectional shape with a second diameter that is greater than the first diameter. In any of the embodiments, the medallion may be affixed to the rear face surface with a plurality of pieces of adhesive tape.

Yet another aspect of the present invention is a golf club head comprising a body comprising a top line section, a bottom section, a face section comprising a striking face surface and a rear face surface, a heel side, a toe side, a lip section, and a rear-facing cavity at least partially defined by the top line section, bottom section, and face section, a medallion comprising an upper section and a lower section, and a bumper, wherein the lip section comprises a front lip surface and a rear lip surface and extends from the bottom section into the rear-facing cavity approximately parallel with the rear face surface, wherein the upper section of the medallion is affixed to the rear face surface so that the lower section extends over the lip section, wherein the bumper is trapped between the rear lip surface and the lower section of the medallion, wherein no portion of the bumper makes contact with the rear face surface, and wherein the bumper damps vibration in the face section after the face section impacts a golf ball.

In some embodiments, the lower section of the medallion may be offset from the upper section so that the upper section is disposed closer to the rear face surface than the lower section. In other embodiments, the bumper may be affixed to only one of the lip section and the medallion with an adhesive material. In still other embodiments, the lip section may extend from the heel side to the toe side of the bottom section. In one embodiment, a portion of the lip section may be aligned with a center of the striking face surface along a horizontal x-axis extending through the center of the striking face surface perpendicular to the striking face surface. In any of the embodiments, the body may be composed of a metal alloy material, the medallion may be composed of a plastic material, and the bumper may be composed of a rubber material.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
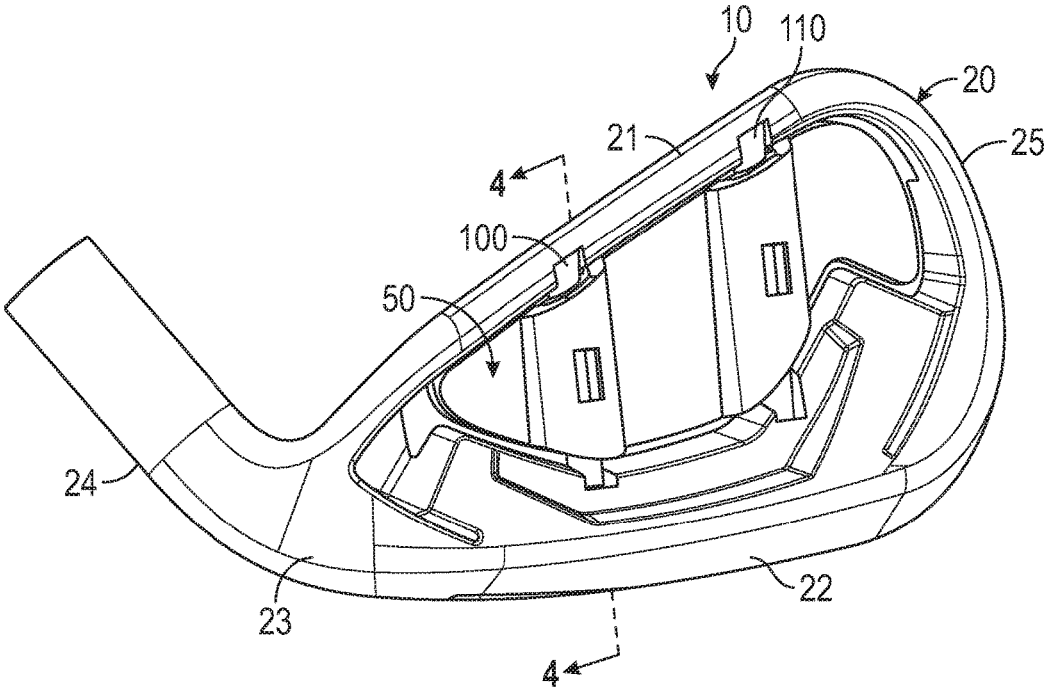
FIG. 1 is a rear elevational view of the preferred embodiment of the golf club head of the present invention.
Figure 2:
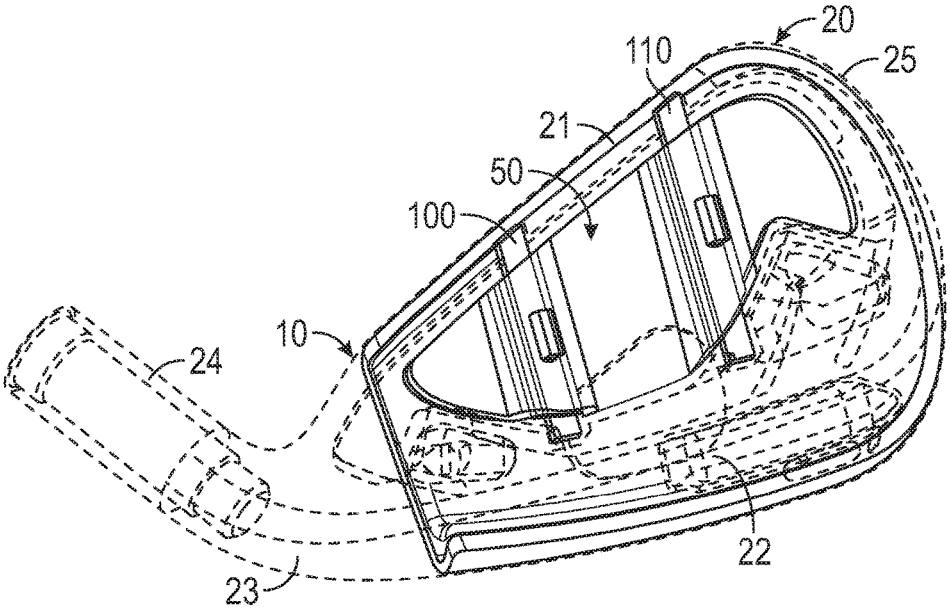
FIG. 2 is a partially transparent view of the golf club head shown in FIG. 1.
Figure 3:
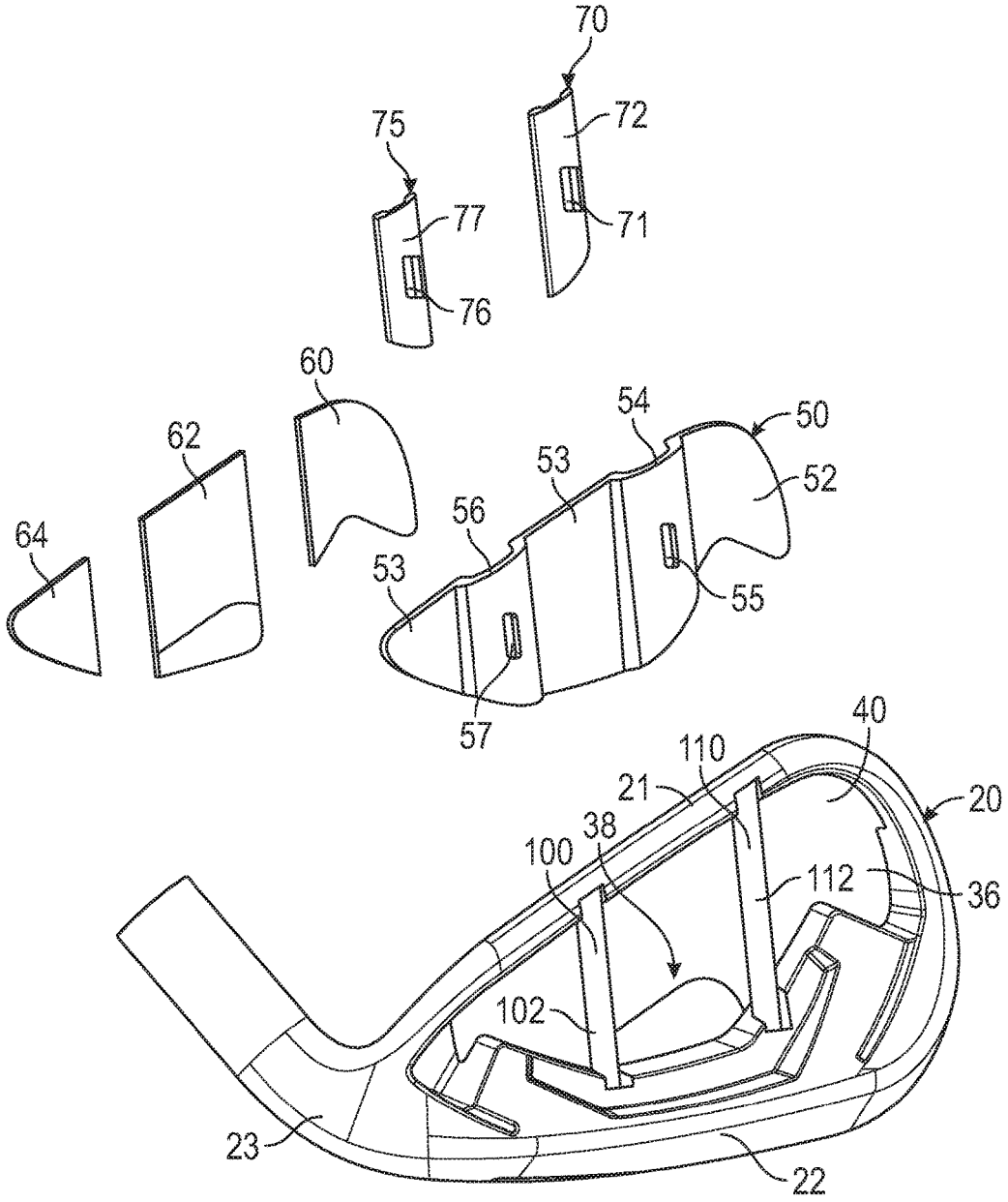
FIG. 3 is a partially exploded view of the golf club head shown in FIG. 1.
Figure 4:
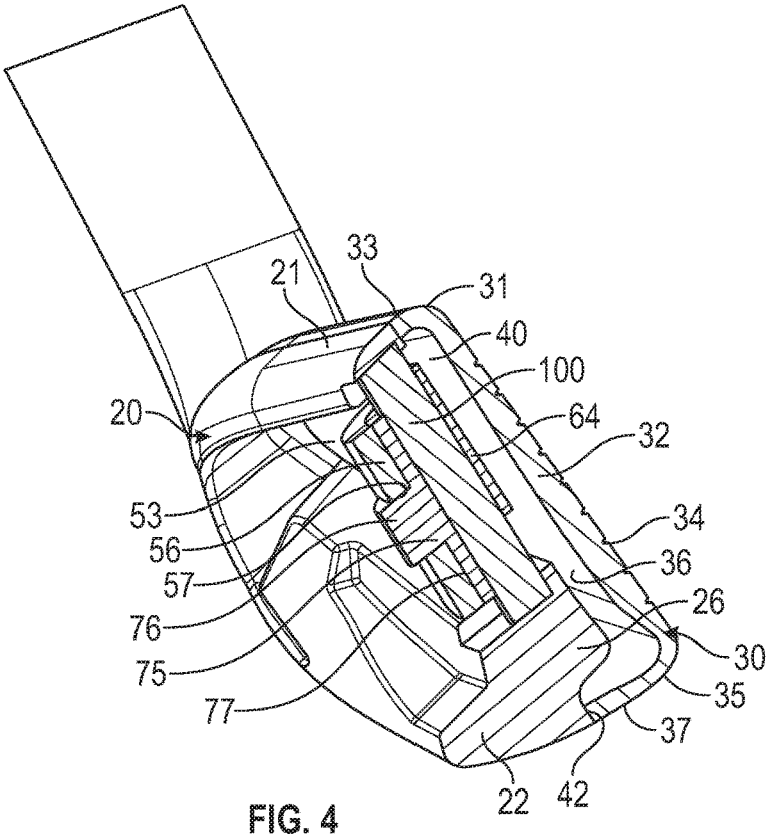
FIG. 4 is a cross-sectional view of the golf club head shown in FIG. 1 along lines 4-4.

The golf club head of the present invention is designed to damp vibrations in the striking face after the golf club head impacts a golf ball without impeding the performance of the striking face (which may include performance optimizing variable face thickness patterns) with respect to ball velocity. The damping effect is produced while the striking face rebounds from impact.

A first, preferred embodiment of the present invention is shown in FIGS. 1-6. The golf club head 10 comprises a body 20 having a top line section 21, a bottom section 22, a heel side 23 where a hosel 24 connects with the body 20, and a toe side 25, and a face cup 30 comprising a striking face 32 with a front striking surface 34, a rear surface 36 opposite the front striking surface 34, an upper flange 33 extending from an upper edge 31 of the striking face 32, and a lower flange 37 extending from a lower edge 35 of the striking face 32. The striking face 32 has a geometric face center 38 and preferably comprises a variable thickness pattern. When the face cup 30 is affixed to the body 20 by welding or otherwise connecting the upper flange 33 to the top line section 21 and the lower flange 37 to the bottom section 22, the two parts define a hollow, rear-facing cavity 40. As shown in these Figures, an upper portion 26 of the bottom section 22 preferably extends over the seam 42 where the lower flange 37 connects to the bottom section 22, and towards the face cup 30, as disclosed in U.S. Pat. Nos. 8,257,195, 9,211,451, or 9,586,105, the disclosure of each of which is hereby incorporated by reference in its entirety herein.

Figure 5:
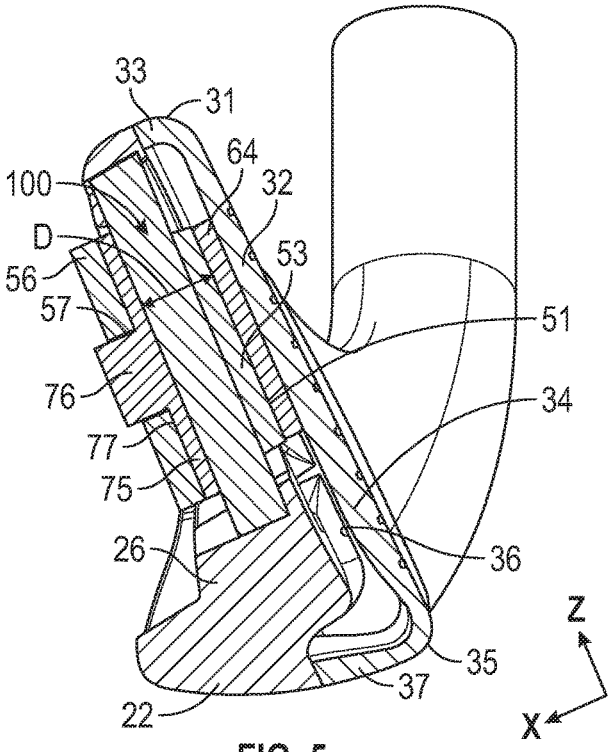
FIG. 5 is a plan view of the cross-section shown in FIG. 4.

The golf club head 10 also includes first and second elongated stiffening rods 100, 110, each of which extends from the top line section 21 to the bottom section 22 so that a middle section 102, 112 of the stiffening rod 100, 110 is suspended within the hollow cavity 40. The stiffening rods 100, 110 extend approximately parallel with the rear surface 36 of the striking face 32 without making contact with any portion of the striking face 32, even when the striking face 32 impacts a golf ball. The first stiffening rod 100 preferably is disposed between the face center 38 and the heel side 23, while the second stiffening rod 110 is disposed between the face center 38 and the toe side 25. As shown in FIG. 5, each stiffening rod 100, 110 is preferably located within a distance D of 1 inch of the rear surface 36 of the striking face 32 measured along a XZ vertical plane extending through the face center 38 perpendicular to the striking face 32. No portion of either of the stiffening rods 100, 110 should be located outside of this 1-inch distance D; in fact, it is more preferable for each stiffening rod 100, 110 to be located within 0.500 inch of the rear surface 36 to improve ball speed and reduce the stress placed on the striking face 32 during impact with a golf ball.

Each stiffening rod 100, 110 preferably has an approximately cylindrical shape, with a diameter of 0.050 inch to 0.200 inch and a top-to-bottom length of 1 to 2.5 inches, and a radius of curvature ranging from 0.02 inch to 0.1 inch, more preferably 0.025 inch to 0.05 inch. Each of the stiffening rods 100, 110 may be co-cast with the body 20, or may be welded to the top line section 21 and bottom section 22 after being manufactured separately from the body 20. Each elongated stiffening rod 100, 110 preferably is a solid rod composed of a lightweight, strong metal material such as titanium alloy or steel. If the elongated stiffening rods 100, 110 are co-cast with the body 20, the combination may be accomplished using the method disclosed in U.S. patent application Ser. No. 15/808,025, the disclosure of which is hereby incorporated by reference in its entirety herein. If the elongated stiffening rods 100, 110 are formed separately from the body 20, they may be composed of a different material. The stiffening rods 100, 110 may also have any of the features disclosed in U.S. Pat. Nos. 9,486,677, 9,597,558, 9,597,561, 9,687,701, 9,687,702, 9,694,257, 9,757,629, 9,776,058, 9,814,947, and 9,827,469, the disclosure of each of which is hereby incorporated by reference in its entirety herein, or the features disclosed in U.S. patent application Ser. Nos. 62/445,983, 62/507,640, 15/167,588, 15/392,818, 15/432,655, 15/628,364, and 15/812,674, the disclosure of which is hereby incorporated by reference in its entirety herein.

The golf club head 10 also includes a medallion 50 with a front surface 51, a rear surface 52, a planar portion 53 sized to cover the rear surface 36 of the striking face 32, and a pair of vertical channels 54, 56, each of which has an approximately tubular cross-sectional shape and includes a through-hole 55, 57. Each of the vertical channels 54, 56 receives a bumper 70, 75, which has a protrusion 71, 76 extending from its rear surface 72, 77. Each protrusion 71, 76 extends through, and is received by, a through-hole 55, 57 so that the respective bumper 70, 75 is properly centered within its respective vertical channel 54, 56 of the medallion 50.

The planar portion 53 of the medallion 50 extends approximately parallel with the rear surface 36 of the striking face, and the front surface 51 of the medallion 50 is affixed to the rear surface 36 with several pieces of adhesive tape 60, 62, 64. When the medallion 50 is properly disposed on the rear surface 36 of the striking face 32, most of the middle section 102 of the first elongated stiffening rod 100 is received in the heel-side vertical channel 56, trapping the bumper 75 located in that vertical channel 56 between the medallion 50 and the elongated stiffening rod 100, and most of the middle section 112 of the second elongated stiffening rod 110 is received in the toe-side vertical channel 54, trapping the bumper 70 located in that vertical channel 54 between the medallion 50 and the elongated stiffening rod 110. The vertical channels 54, 56, which have diameters that are larger than that of the diameters of both the elongated stiffening rods 100, 110 and the bumpers 70, 75, obscure the bumpers 70, 75 and much of the elongated stiffening rods 100, 110 from view when the medallion 50 is affixed to the rear surface 36 of the striking face 32. The medallion 50 preferably does not make direct contact with the elongated stiffening rods 100, 110, but instead extends over and around them.

Figure 6C:
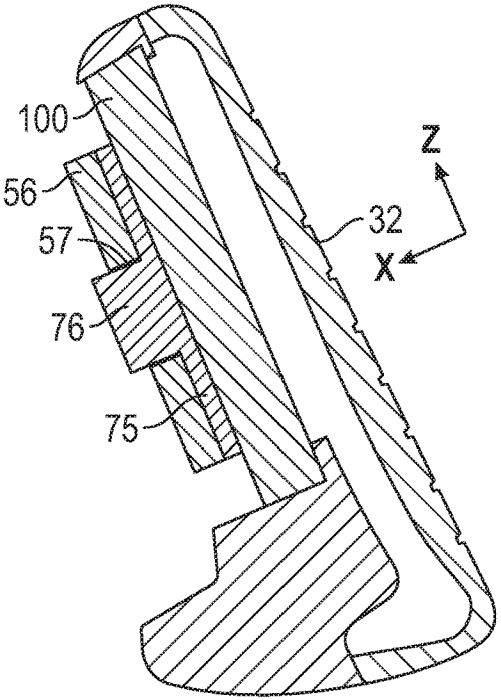
FIGS. 6A-6C are plan views of the cross-section shown in FIG. 4 before impact with a golf ball (A), immediately after impact with a golf ball (B), and at rest after impact with a golf ball (C).
Figure 6B:
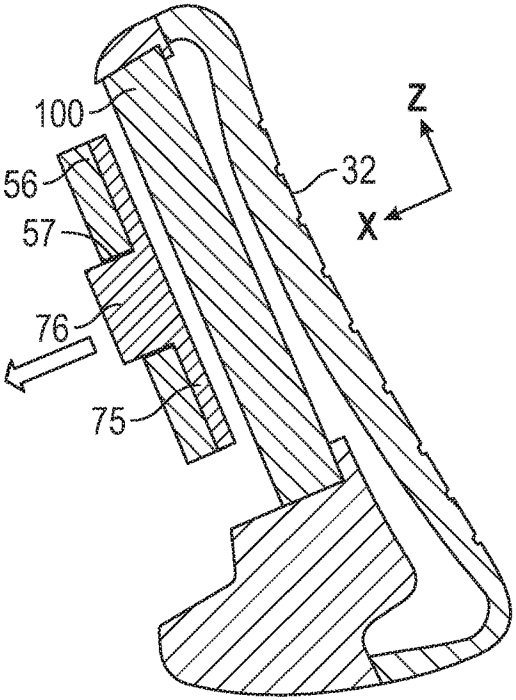
Figure 6A:
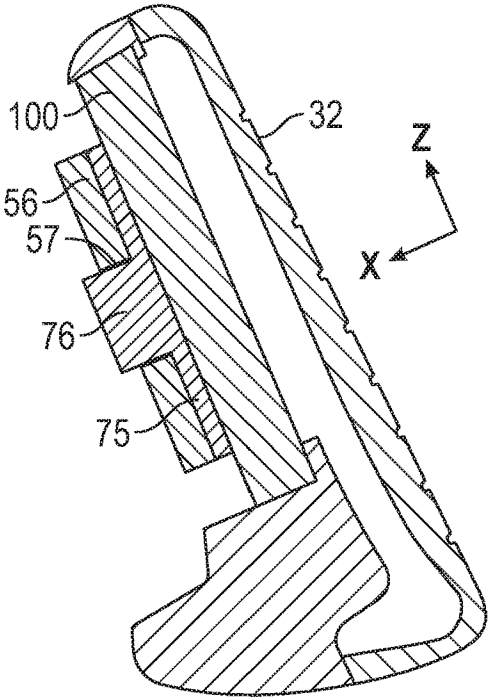

In this embodiment, the bumpers 70, 75 are affixed to the medallion 50 with an adhesive material, but not to the elongated stiffening rods 100, 110, so that the bumpers 70, 75 are free to move away from the stiffening rods 100, 110 during, and immediately after, impact between the striking face 32 and a golf ball. FIGS. 6A-6C illustrate how the preferred embodiment of the golf club head 10 moves before and after impact with a golf ball (not shown). The bumpers 70, 75 each are in contact with a stiffening rod 100, 110 when the golf club head 10 is at rest, as shown in FIG. 6A. After the striking face 32 impacts a golf ball, the bumpers 70, 75 and vertical channels 54, 56 of the medallion 50 deflect along with the striking face in a rearward direction, as shown in FIG. 6B. The striking face 32 is also free to deflect opposite the direction of ball travel, without making contact with the bumpers 70, 75 or the stiffening rods 100, 110. When the striking face 32 returns to its rest state, as shown in FIG. 6C, the bumpers 70, 75 make contact with the stiffening rods 100, 110 again and damp vibrations in the striking face 32.

Figure 7:
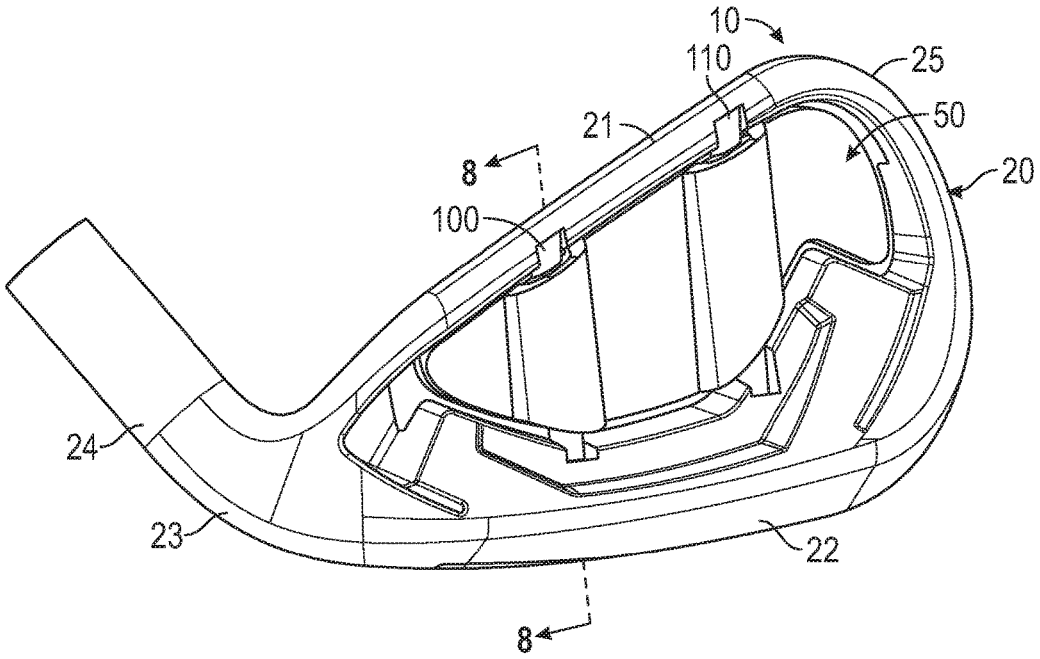
FIG. 7 is a rear perspective view of a second embodiment of the golf club head of the present invention.
Figure 8:
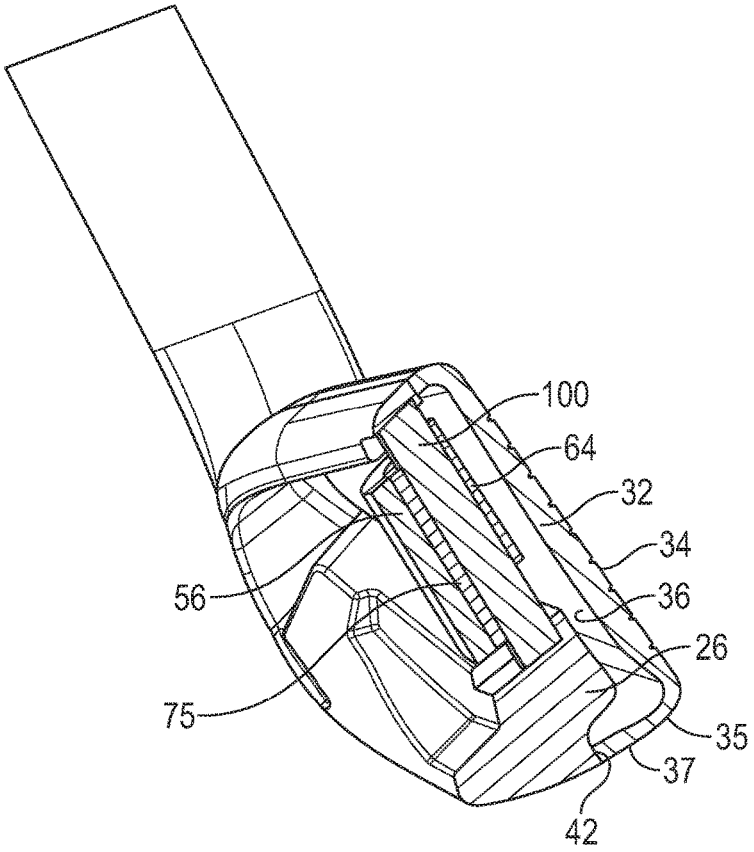
FIG. 8 is a cross-sectional view of the golf club head shown in FIG. 7 along lines 8-8.
Figure 9C:
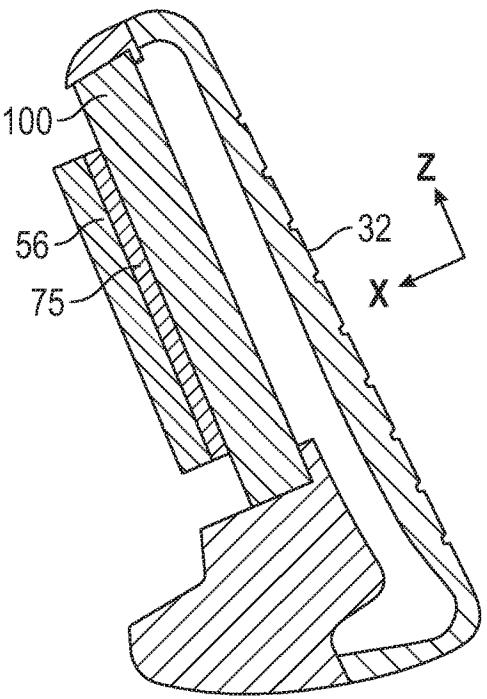
FIGS. 9A-9C are plan views of the cross-section shown in FIG. 8 before impact with a golf ball (A), immediately after impact with a golf ball (B), and at rest after impact with a golf ball (C).
Figure 9B:
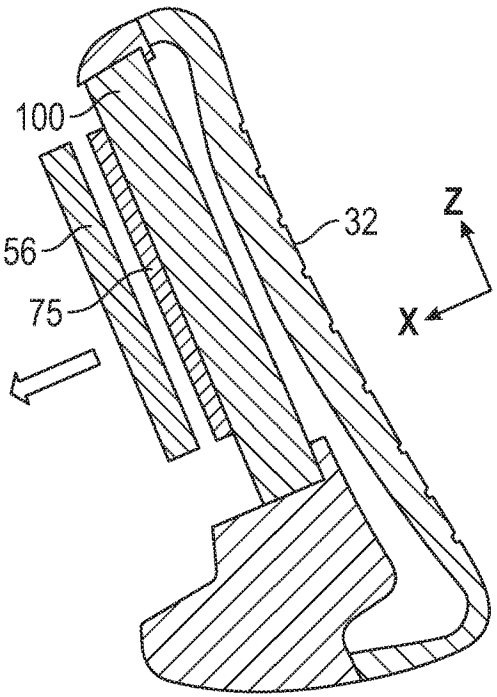
Figure 9A:
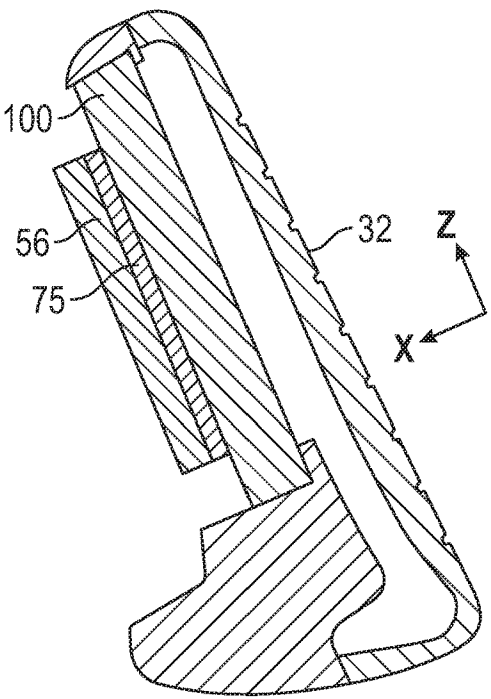
Figure 10:
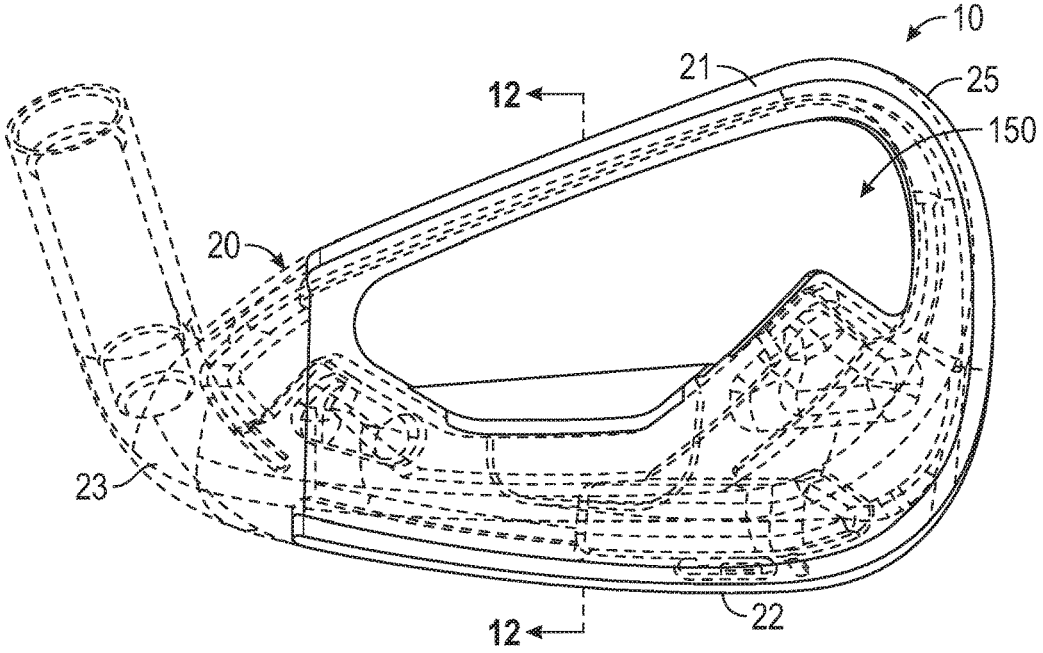
FIG. 10 is a rear elevational, partially transparent view of a third embodiment of the golf club head of the present invention.
Figure 11:
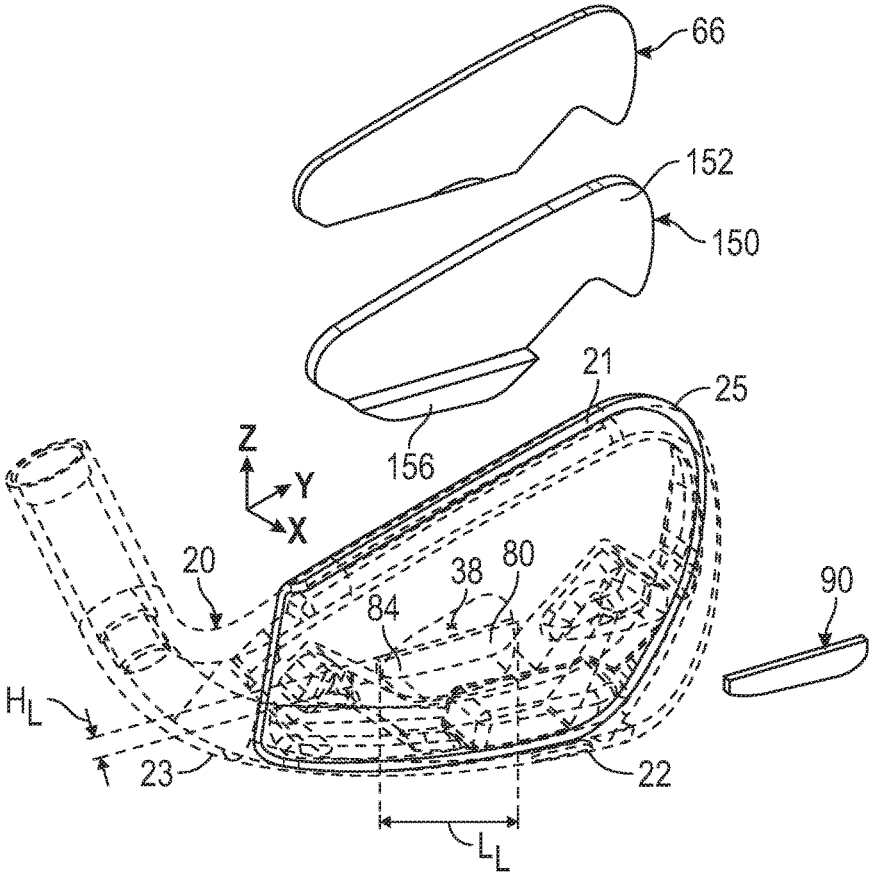
FIG. 11 is a partially exploded view of the golf club head shown in FIG. 10.
Figure 12:
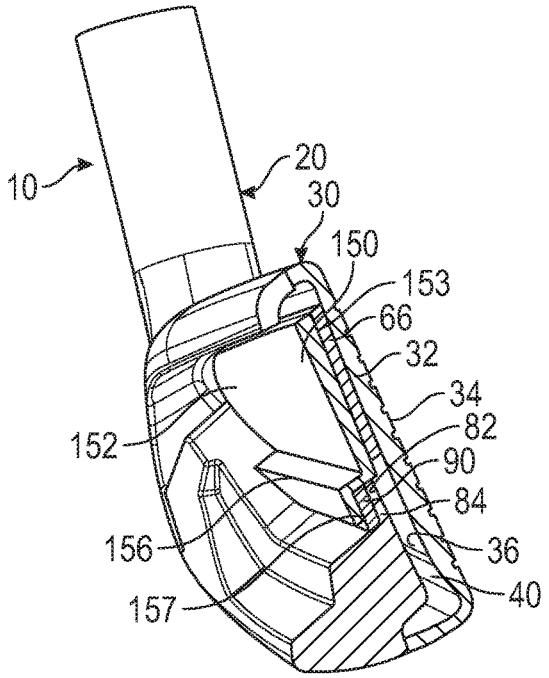
FIG. 12 is a cross-sectional view of the golf club head shown in FIG. 10 along lines 12-12.
Figure 13:
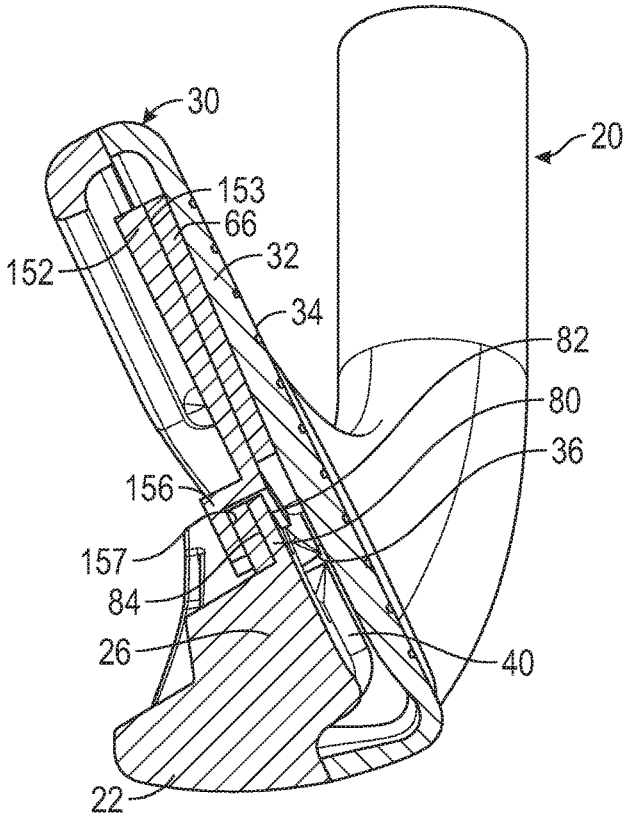
FIG. 13 is a plan view of the cross-section shown in FIG. 12.
Figure 14:
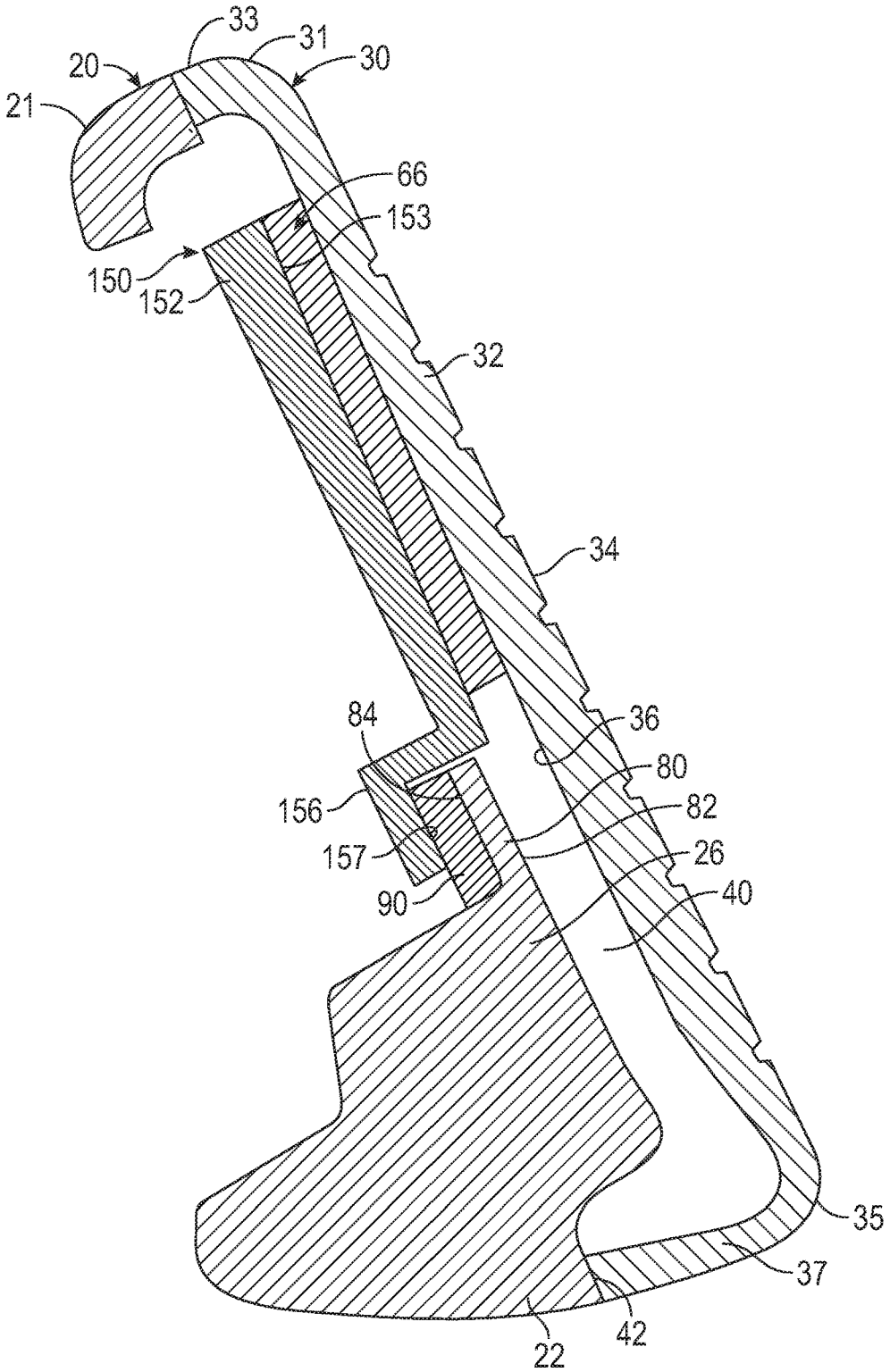
FIG. 14 is an enlarged view of the cross-section shown in FIG. 13.

A second embodiment of the golf club head 10 is shown in FIGS. 7-9. In this embodiment, the golf club head 10 has all of the same features as the preferred embodiment, except that the bumpers 70, 75 do not have protrusions 71, 76, the vertical channels 54, 56 do not have through-holes 55, 57, and the bumpers 70, 75 are affixed to the elongated stiffening rods 100, 110, but not the medallion 50, with an adhesive material. FIGS. 9A-9C illustrate how this embodiment of the golf club head 10 moves before and after impact with a golf ball. Each bumper 70, 75, which is adhered to a stiffening rod 100, 110 with an adhesive, is in contact with the medallion 50 when the golf club head 10 is at rest, before impact, as shown in FIG. 9A. Immediately after impact, as shown in FIG. 9B, the medallion 50 deflects, along with the striking face 32, in a rearward direction, while the bumper 70, 75 remains affixed to the stiffening rod 100, 110. The striking face 32 in this embodiment is free to move without making contact with any portion of the bumpers 70, 75 or the stiffening rods 100, 110. After the striking face 32 returns to its resting state, the bumpers 70, 75 damp vibrations in the striking face, as shown in FIG. 9C.

A third embodiment of the present invention is shown in FIGS. 10-14. In this embodiment, the golf club head 10 includes many of the same features as the preferred embodiment of the present invention, with a similar body 20, a similar face cup 30, and a medallion 150. Instead of elongated stiffening rods, however, the golf club head 10 of this embodiment includes a thin lip 80 extending vertically over the rear facing cavity 40 from the upper portion 26 of the bottom section 22 of the body 20 and parallel with the rear surface 36 of the striking face 32, such that a portion of the lip 80 is approximately aligned with the face center 38 along the horizontal x-axis. The lip 80 has a vertical top-to-bottom height HL that is less than its horizontal heel-to-toe length LL, such that the lip 80 is approximately rectangular in shape, and extends from a heel side 23 of the bottom section 22 to the toe side 25 of the bottom section 22. The lip 80 has a front surface 82 and a rear surface 84, with the front surface 82 facing the hollow cavity 40 and spaced from the rear surface 36 of the striking face 32.

The medallion 150 of this invention comprises an upper section 152 that is offset from a smaller, lower section 156 along the x-axis, such that the upper section 152 is located closer to the rear surface 36 of the striking face 32 than the lower section 156 when the medallion 150 is engaged with the striking face 32. The upper section comprises a front surface 153 that is affixed to a portion of the rear surface 36 of the striking face 32 with a piece of adhesive tape 66, while the lower section 156, which has approximately the same height and length dimensions as the lip 80, extends over the lip 80. A bumper 90 also having the same approximate height and length dimensions as the lip 80 is disposed between the lower section 156 and the rear surface 84 of the lip 80.

When the medallion 150 and bumper 90 are assembled with the body 20, both the lip 80 and the bumper 90 are obscured from view and the bumper 90 is trapped between a front surface 157 of the lower section 156 and the rear surface 84 of the lip 80. As with the other embodiments, the lower section 156 does not make direct contact with the lip 80, and neither the lip 80 nor the bumper 90 directly contacts the striking face 32. The bumper 90 is affixed via adhesive to only one of the front surface 157 of the lower section 156 and the rear surface 84 of the lip 80, so that it can function in one of the ways shown in FIGS. 6A-C and FIGS. 9A-C; e.g., the bumper 90 and lower section 156 of the medallion both deflect in a rearward direction while the striking face 32 moves, or only the lower section 156 deflects in a rearward direction while the striking face 32 moves, after impact of the striking face 32 with a golf ball. In either situation, after the golf club head 10 returns to its resting state, the bumper 90 damps vibrations in the striking face 32 caused by the impact.

In each of the embodiments disclosed herein, the medallion 50, 150 is preferably composed of a lightweight, resilient material such as plastic or composite material, the bumpers 70, 75, 90 are composed of an elastic material such as rubber, and each of the body 20 and the face cup 30 is composed of one or more metal alloy materials, such as stainless steel or titanium alloy.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. An iron-type golf club head comprising:

a body comprising a top line section, a bottom section, a face section comprising a striking face surface and a rear face surface, a heel side, a toe side, and a hollow cavity at least partially defined by the top line section, bottom section, and face section;

at least one support structure extending from the bottom section into the hollow cavity approximately parallel with the rear face surface;

a medallion comprising a front medallion surface and a rear medallion surface; and a bumper, wherein no portion of the at least one support structure makes direct contact with the face section, wherein the front medallion surface is affixed to the rear face surface so that a portion of the medallion extends over at least a portion of the at least one support structure, wherein the bumper is disposed between the front medallion surface and the at least one support structure, wherein the bumper is affixed to only one of the medallion and the at least one support structure with an adhesive material, wherein a portion of at least one of the medallion and the at least one bumper moves away from the face section when the face section impacts a golf ball, and wherein the bumper damps vibration in the face section after impact with the golf ball.

2. The iron-type golf club head of claim 1, wherein the at least one support structure is an elongated rod extending from the bottom section to the top line section so that a middle portion of the at least one support structure is suspended within the hollow cavity.

3. The iron-type golf club head of claim 1, wherein the medallion comprises a through-opening extending from the rear medallion surface to the front medallion surface, wherein the bumper comprises a rear protrusion, and wherein the rear protrusion extends into the through-opening when the medallion is affixed to the face section.

4. The iron-type golf club head of claim 1, wherein the face section is a face cup comprising an upper flange and a lower flange, wherein the upper flange is welded to the top line section, and wherein the lower flange is welded to the bottom section.

5. The iron-type golf club head of claim 1, wherein no portion of the front medallion surface makes direct contact with the at least one support structure.

6. The iron-type golf club head of claim 1, wherein no portion of the bumper makes direct contact with the face section.

7. A golf club head comprising:

a body comprising a top line section, a bottom section, a hosel disposed at a heel side, and a toe side opposite the heel side;

a face component comprising a striking face surface, a rear face surface opposite the striking face surface, an upper flange, and a lower flange;

an elongated stiffening rod;

a medallion comprising an elongated vertical channel; and a bumper, wherein the upper flange is permanently affixed to the top line section and the lower flange is permanently affixed to the bottom section to define an internal cavity, wherein the elongated stiffening rod extends from the bottom section to the top line section through the internal cavity, wherein the elongated stiffening rod extends approximately parallel with the rear face surface without making contact with any portion of the face component, wherein the medallion is affixed to the rear face surface, wherein a middle portion of the elongated stiffening rod is disposed within the elongated vertical channel, wherein the bumper is disposed between the elongated stiffening rod and the medallion within the elongated vertical channel, wherein no portion of the bumper makes contact with any portion of the face component, and wherein the bumper damps vibration in the striking face.

8. The golf club head of claim 7, wherein the bumper is affixed to only one of the elongated stiffening rod and the medallion with an adhesive material.

9. The golf club head of claim 7, wherein the medallion comprises an opening, wherein the bumper comprises a protrusion, and wherein the protrusion extends into the opening.

10. The golf club head of claim 7, wherein the medallion is composed of plastic, and wherein the bumper is composed of rubber.

11. The golf club head of claim 7, wherein the elongated stiffening rod is integrally cast with the body, wherein the body is composed of a first metal alloy material, wherein the face component is composed of a second metal alloy material, and wherein the first metal alloy material is different from the second metal alloy material.

12. The golf club head of claim 7, wherein the elongated stiffening rod is disposed less than 0.500 inch from the rear face surface.

13. The golf club head of claim 7, wherein the elongated stiffening rod has a cylindrical shape with a first diameter, and wherein the elongated vertical channel has an approximately tubular cross-sectional shape with a second diameter that is greater than the first diameter.

14. The golf club head of claim 7, wherein the medallion is affixed to the rear face surface with a plurality of pieces of adhesive tape.

15. A golf club head comprising:

a body comprising a top line section, a bottom section, a face section comprising a striking face surface and a rear face surface, a heel side, a toe side, a lip section, and a rear-facing cavity at least partially defined by the top line section, bottom section, and face section;

a medallion comprising an upper section and a lower section; and a bumper, wherein the lip section comprises a front lip surface and a rear lip surface and extends from the bottom section into the rear-facing cavity approximately parallel with the rear face surface, wherein the upper section of the medallion is affixed to the rear face surface so that the lower section extends over the lip section, wherein the bumper is trapped between the rear lip surface and the lower section of the medallion, wherein no portion of the bumper makes contact with the rear face surface, and wherein the bumper damps vibration in the face section after the face section impacts a golf ball.

16. The golf club head of claim 15, wherein the lower section of the medallion is offset from the upper section so that the upper section is disposed closer to the rear face surface than the lower section.

17. The golf club head of claim 15, wherein the bumper is affixed to only one of the lip section and the medallion with an adhesive material.

18. The golf club head of claim 15, wherein the lip section extends from the heel side to the toe side of the bottom section.

19. The golf club head of claim 15, wherein a portion of the lip section is aligned with a center of the striking face surface along a horizontal x-axis extending through the center of the striking face surface perpendicular to the striking face surface.

20. The golf club head of claim 15, wherein the body is composed of a metal alloy material, wherein the medallion is composed of a plastic material, and wherein the bumper is composed of a rubber material.

* * * * *